US005208917A

United States Patent [19]

Acenbrack

[11] Patent Number: 5,208,917

[45] Date of Patent: May 11, 1993

[54] NECK-LESS NECKWEAR

[76] Inventor: Donald F. Acenbrack, 1926 Sever Dr., Clearwater, Fla. 34624

[21] Appl. No.: 680,388

[22] Filed: Apr. 4, 1991

[51] Int. Cl.[5] ..... A41B 1/18; A41B 1/22; A41D 25/02; A41D 25/04

[52] U.S. Cl. ..... 2/113; 2/48; 2/49 R; 2/115; 2/145; 2/149

[58] Field of Search ..... 2/46, 48, 49 R, 50, 2/51, 52, 75, 80, 104, 113, 105, 106, 118, 119, 122, 137, 145, DIG. 7, 115

[56] References Cited

U.S. PATENT DOCUMENTS

| | | | |
|---|---|---|---|
| 860,257 | 7/1907 | Slater | 2/49 R |
| 1,316,577 | 9/1919 | Inderrieden | 2/137 |
| 1,733,555 | 10/1929 | Nutt | 2/46 |
| 2,052,144 | 8/1936 | Krantz | 2/46 |
| 2,093,483 | 9/1937 | Sackett | 2/50 |
| 2,262,010 | 11/1941 | Kuehne | 2/49 R |
| 2,387,060 | 10/1945 | Corbi | 2/115 |
| 2,414,616 | 1/1947 | Staw | 2/46 |
| 2,543,361 | 2/1951 | Garner | 2/119 |
| 2,556,039 | 6/1951 | Landert | 2/119 X |
| 2,568,826 | 9/1951 | Roussos | 2/144 X |
| 2,688,136 | 9/1954 | Freedman | 2/122 X |
| 2,712,650 | 7/1955 | Harrington | 2/119 |
| 3,230,547 | 1/1966 | Moran, Jr. | 2/119 |
| 3,261,025 | 7/1966 | Simek | 2/137 X |
| 3,439,360 | 4/1969 | Grubman | 2/155 |
| 3,833,937 | 9/1974 | Taylor | 2/46 |
| 4,330,888 | 5/1982 | Klepfer | 2/48 |
| 4,604,758 | 8/1986 | Grasberger et al. | 2/49 R |
| 4,733,411 | 3/1988 | Foti | 2/49 R |
| 4,885,805 | 12/1989 | Mason | 2/115 X |
| 4,924,528 | 5/1990 | Trombetti-Dickens | 2/49 R |
| 5,029,343 | 7/1991 | McIntyre | 2/46 X |

FOREIGN PATENT DOCUMENTS

| | | | |
|---|---|---|---|
| 2880 | 8/1890 | Fed. Rep. of Germany | 2/119 |
| 509510 | 11/1920 | France | 2/119 |

*Primary Examiner*—Clifford D. Crowder
*Assistant Examiner*—Jeanette E. Chapman
*Attorney, Agent, or Firm*—Joseph C. Mason, Jr.; Ronald E. Smith

[57] ABSTRACT

An article of clothing so constructed as to not encircle the wearer's neck, combines a support undergarment with a neckwear outergarment. The support undergarment is a collarless and sleeveless shirt worn beneath a male's shirt or a female's blouse. The outergarment is an ornamental fabric necktie of pretied configuration and includes longitudinal pairs of same fabric shoulder tailends projecting from each upper corner of the knot-end of the necktie. Button fasteners sewn along the undergarment's shoulder straps releasably communicate with button holes sewn along tailends.

4 Claims, 4 Drawing Sheets

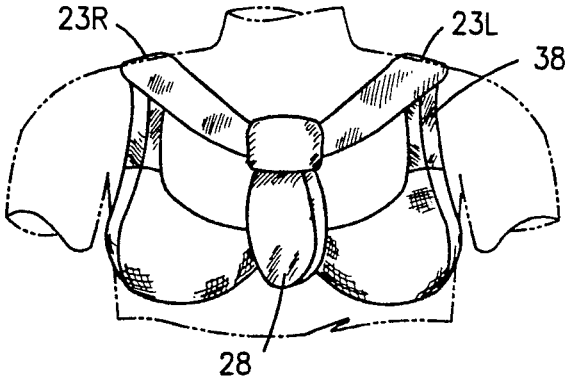
Fig. 7
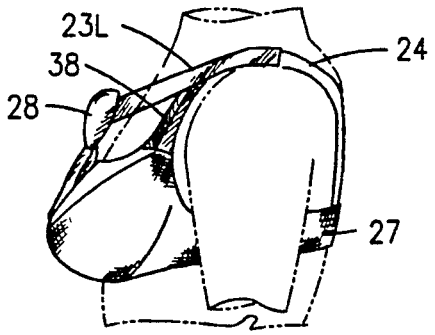
Fig. 9
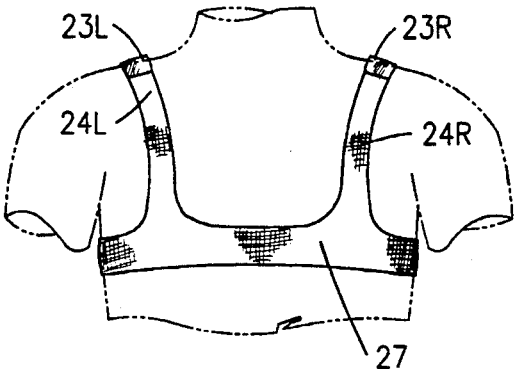
Fig. 8
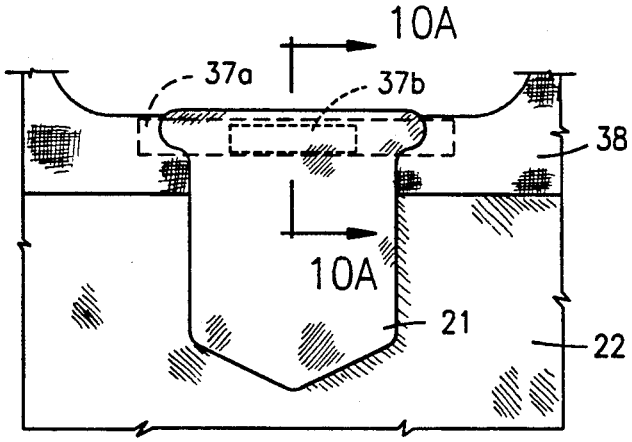
Fig. 10
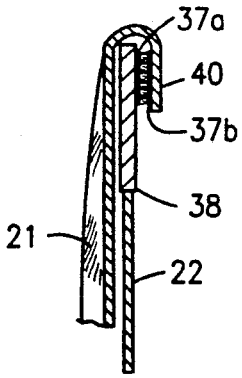
Fig. 10-A

NECK-LESS NECKWEAR

BACKGROUND OF THE INVENTION

The invention pertains to new and improved structures of neckwear apparel with the aim of providing comfort and convenience by providing a two component, ornamental neckwear which utilizes other than the wearer's neck itself as the means for supporting such apparel.

Ever since the invention of neck ornaments, individuals have been forced to endure the discomfort of having tightly fitting fabric encircling their necks merely to conform to one of the mores of society. The apparent reason for this acceptance of choking discomfort is the logic that since neckwear apparel must be supported to stay in place, such support must be provided by having the item encircle the neck of the wearer.

SUMMARY OF THE INVENTION

It is therefore the primary object of this invention to provide a neckwear structure which greatly improves the comfort of individuals adorned with neckwear by sparing them the need to have confining material enclosing their neck. Another feature of this invention is to permit simple and rapid useage of the neckwear outergarment because no tying or shaping adjustments are required, since those actions have already been completed during manufacture of the item.

A further feature of this invention results from providing neckwear apparel having a wide latitude in selection of types and configurations of material used in the manufacture of the outergarment. In the ascot embodiment, the preshaped and prepositioned construction finally provides a garment which is not tied around the neck and therefore remains in place regardless of how active the wearer becomes. Another object of this invention is to provide a longer lasting outergarment or necktie due to less handling being necessary when the item is put on or removed.

A major advantage of this neckwear construction is vast improvement in phychological predisposition toward wearing such apparel due to the absence of discomfort from having the garment encircle one's neck and thereby projecting excessive warmth at the neck and subsonscious concerns about being choked or worse.

BRIEF DESCRIPTION OF THE DRAWINGS

In the drawings, closely related figures have the same numbers but different alphabetic suffixes.

FIG. 7 is an overall front view of female ornamental neckwear showing it worn in conjunction with a support undergarment —female.

FIG. 8 is an overall back view of a support undergarment —female showing tailends attached to shoulder straps.

FIG. 9 is a left side view of female ornamental neckwear, the support undergarment —female and left shoulder tailend attached to left shoulder strap.

FIG. 10 is a detailed front view of an ascot attached to a support undergarment.

FIG. 10*a* is a vertical sectional view taken along line 10-10 of FIG. 10. Phantom lines indicate the position of the hook and loop strip 37*a* on the rear side of the garment.

FIG. 13 is an enlarged front view of a neck-less necktie showing method of attachment to a support undergarment.

DETAILED DESCRIPTION OF THE PREFERRED EMBODIMENT

Figure 1:
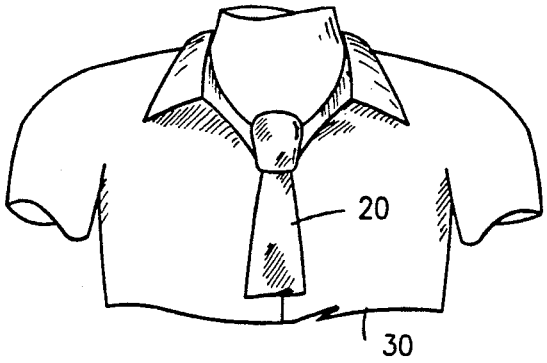
FIG. 1 is an overall front view of an ornamental outergarmetn—male as it is worn with a dress shirt, the shirt shown for purposes of clarification only.
Figure 2:
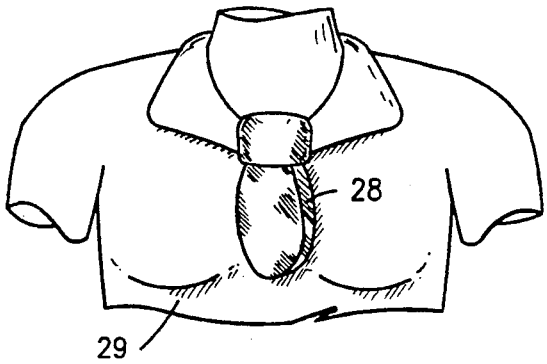
FIG. 2 is an overall front view of female ornamental neckwear as it is worn with a blouse.
Figure 3:
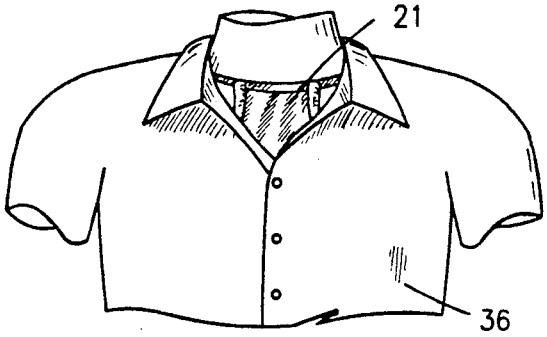
FIG. 3 is an overall view of an ascot as it is worn with an open-neck shirt.

Typical embodiments of the present invention are illustrated in FIGS. 1, 2 and 3. Conventionally, when neckwear is worn, a neckband encloses the wearer's neck. In the present invention, the ornamental fabric outergarment —male necktie 20 is comprised of a typical necktie configuration. However, support of this neckwear apparel is provided by a support undergarment —male 22 as shown worn beneath a dress shirt —male 30. Similarly, FIG. 2 shows the outward appearance of the invention when an ornamental fabric outergarment female necktie 28 is worn with a blouse —female 29. Again in FIG. 3, an alternative embodiment shows the outward appearance of the invention when an ornamental fabric outergarment —male ascot 21 is worn in conjunction with an open neck shirt 36.

Figure 4:
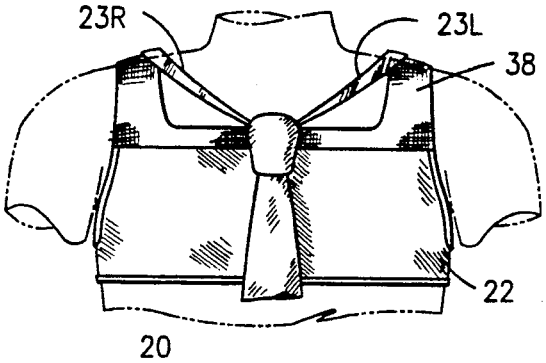
FIG. 4 is an overall front view of an ornamental outergarment—male showing it worn in conjunction with a support undergarment —male.
Figure 5:
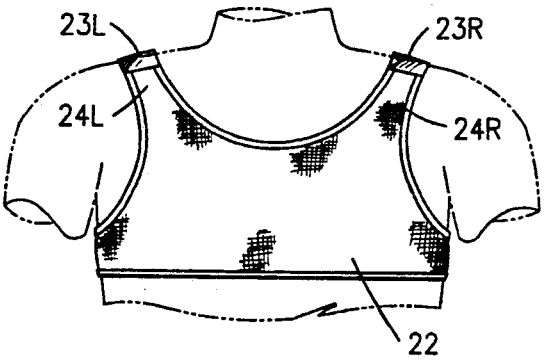
FIG. 5 is an overall back view of a support undergarment —male showing tailends attached to shoulder straps.
Figure 6:
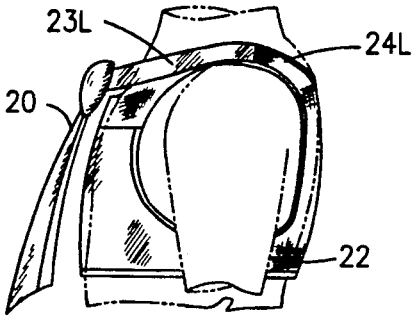
FIG. 6 is a left side view of an ornamental outergarment —male, support undergarment —male and left shoulder tailend.

Referring to FIGS. 4, 5 and 6, we observe elevational views of the front,back and left side of the undergarment —male 22 which is a collarless and sleeveless shirt having a multiple-ply fabric portion of support undergarment 38*a* padded for increased stiffness to insure that a male necktie 20 is held comfortably in place.

In FIGS. 7, 8 and 9 an alternative embodiment illustrates elevations of the front, back and left side of a support undergarment female 27 which is a brassier-type configuration having a portion of undergarment 38*b* padded for increased stiffness to insure an ornamental fabric outergarment - female necktie 28 is held comfortably in place.

The ascot 21 embodiment is more clearly illustrated in FIGS. 10 and 10*a* and incorporates strips of a hook-and-loop type fastener 37 such as VELCRO (TM) material which are two component, complimentary segments, one having a hook facing and the other having a loop facing. One segment 37*a* of such 37, 37*a* shown in phantom lines, is secured by sewing or other means to the rear side of the garment along the neckline and just below the neck opening of a support undergarment. The complimentary segment of this fastener 37*b* is secured by like means along the back flap 40 of ascot 21. It should be noted that the fastener segment 37*a* is substantially larger than fastener segment 37*b* so as to allow some flexibility in adjusting the location of the ascot 21 if so desired by the wearer.

Figure 11:
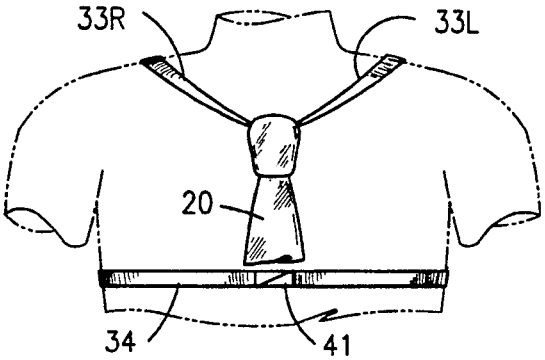
FIG. 11 is an overall front view of a neck-less necktie with a cincture used as the support undergarment.
Figure 12:
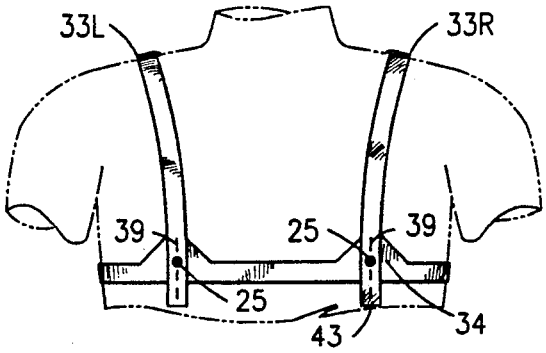
FIG. 12 is an overall back view showing extended tailends of outergarment attached to cincture undergarment.
Figure 12:
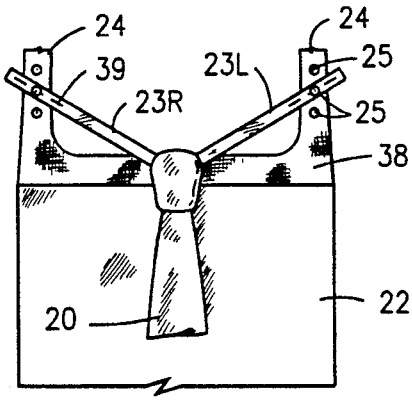

FIGS. 11 and 12 depict an alternative embodiment illustrating a male necktie 20 worn in conjunction with extended tailends of outergarment 33 and a cincture undergarment 34 encircling the wearer's chest. The plurality of buttonholes 39 embedded along extended tailends of outergarment tails 44 provide latitude in adjusting the position of male necktie 20 beneath the chin of the wearer. In addition, both the tailends 33 and the cincture 34 can be manufactured by size as commonly done for most articles of clothing. The cincture undergarment connector 41 may be releasably secured by clasp or other typical means of buckling a cincture.

Figure 14A:
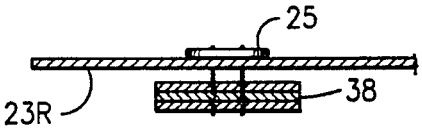
FIG. 14*a* is a detailed section view of FIG. 14 showing a left shoulder tailend attached to a shoulder strap.
Figure 14:
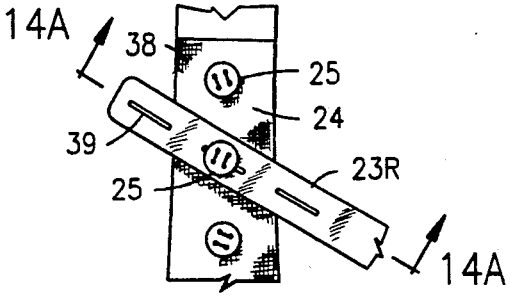
FIG. 14 is a detailed top view of a right shoulder tailend attached to a shoulder strap.

Referring now to FIG. 13, the enlarged elevational view of a male necktie 20 is shown with its shoulder tailends 23 being held in place with button fasteners 25 which are secured along the front segment of a support undergarment shoulder strap 24 which portion is part of the multiple-ply fabric portion of a support undergarment 38. The multiple-ply fabric consists of single plys of material which are secured to each side of a support undergarment —male 22 and female 27 by sewing or other methods as found necessary to provide sufficient stiffness of material to hold exposed neckwear 20, 21 and 28 comfortably in place beneath the wearer's chin. FIGS. 14 and 14*a* show in detail a tailend 23 releasably connected to a shoulder strap 24. The multiplicity of button fasteners 25 and button holes 39 illustrate the means used to provide adjustment to length of tailends 23 towards establishing and maintaining the desired location of an outer-garment —male 20 and female 28 beneath the wearer's chin.

Figure 15:
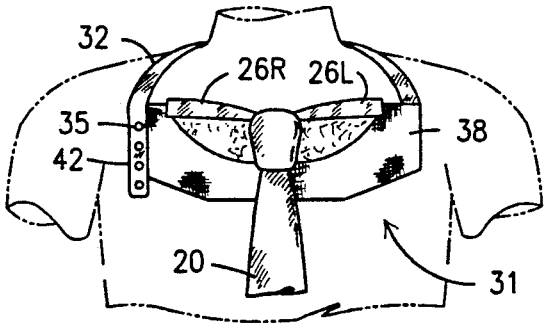
FIG. 15 is front elevational view of an ornamental fabric outergarment attached to a nape-supported bib undergarment.
Figure 16:
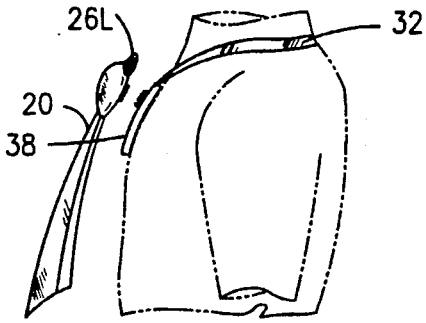
FIG. 16 is a left side view of an outergarment attached to a bib undergarment.
Figure 17:
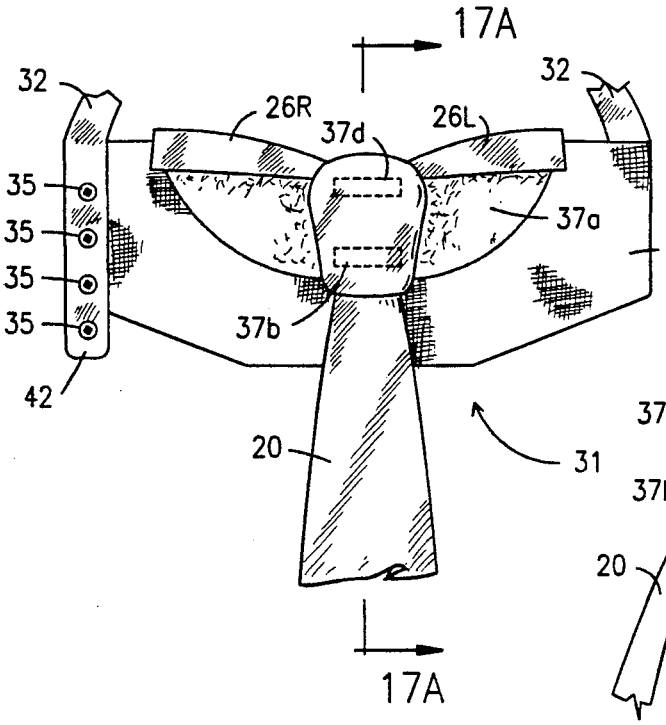
FIG. 17 is an enlarged view of FIG. 15.
Figure 17A:
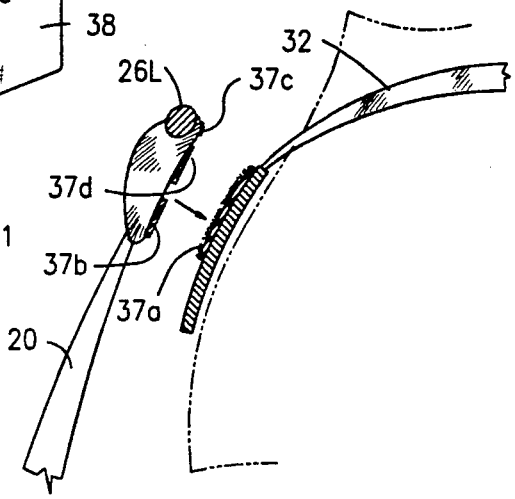
FIG. 17*a* is a vertical section view taken along line 17—17 of FIG. 17.

FIGS. 15, 16, 17 and 17*a* all illustrate a variation of the invention wherein the nape of the wearer's neck is utilized to support a bib undergarment 31. FIG. 15 shows a bib undergarment strap 32 supported by the wearer's nape in a front elevational view. In this embodiment, the portion of a bib undergarment 38*c* encompasses the entire object except the bib strap 32. The plurality of snap fastener 35 along the bib strap tail 43 permit adjustment of the invention to accomodate the wearer's neck size while also providing a means for selecting the desired location of the invention beneath the individual's chin. FIG. 17 and 17*a* are enlarged, vertical front and cross-sectional views showing details of the releasable attachment of neck-wear 20 and 28 having neck area tailends of outergarment 26 releasably secured to a bib undergarment 31. The several segments of strip hook and loop fabric fasteners 37*a, b, c* and *d* illustrate a means used to mate these two constituant parts of the invention. Those familiar wit hook and loop type material know that such two component members are complimentary, thereby allowing one or the other component to be permanently attached to either an outergarment or undergarment. The neck area tailends 26R and L are releasably attached along the neckline of a bib undergarment 31 and are dimensioned in length only sufficiently to insure their exposure beneath an open-necked shirt-male 36 or blouse —female 29.

Figure 18:
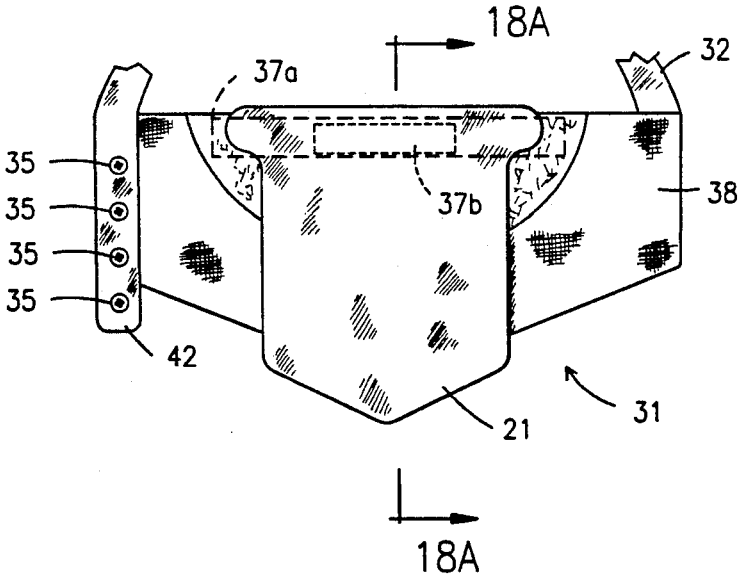
FIG. 18 is an enlarged front elevational view of an ascot attached to a bib undergarment.
Figure 18A:
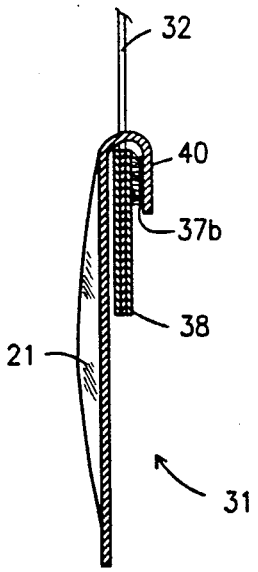
FIG. 18*a* is a vertical section view taken along line 18—18 of FIG. 18.

FIGS. 18 and 18*a* are enlarged, vertical front elevational and cross-sectional views illustrating details of the releasable attachment of an ascot 21 to a bib undergarment 31. The means of attachment replicate those shown in FIG. 10 and 10*a* , wherein strips of fabric fasteners 37 are secured to component items of the invention. One segment 37*a* of the fasteners 37, shown in phantom lines, is secured by sewing or other means to the rear side of the garment along the neckline and just below the neck opening of the support undergarment in the form of a bib. The complimentary segment 37*a* to the fastener 37*a* is secured by like means along the back flap 40 of the ascot 21.

While certain representative embodiments and details have been shown for the purpose of illustrating the invention, it will be apparent to those skilled in this art that various changes and modifications may be made thereto without departinq from the scope or spirit of this invention. The invention is therefore only limited by the scope of the appended claims.

I claim:

1. An article of clothing, comprising:

an under garment worn above the waist;

said under garment having a collarless shirt-like structure, including a neck opening;

an elongate, first releasable fastening means being fixedly secured to a front of said under garment, just below said neck opening on a rearward side thereof so that said first releasable fastening means is not visible when said under garment is worn;

an ascot means, substantially smaller than said under garment, having a second releasable fastening means fixedly secured to a rear surface thereof, said second releasable fastening means being disposed at an uppermost end of said rear surface and said second releasable fastening means releasably engaging said first releasable fastening means when said uppermost end of said ascot means is folded rearwardly so that said second releasable fastening means overlies said first releasable fastening means;

said under garment being substantially covered by an outer garment when an outer garment is worn;

whereby when an outer garment having a shirt-like structure is worn over said under garment, said ascot means appears to be held into its position by a neck-encircling means even though no neck-encircling means is provided.

2. The article of clothing of claim 2, wherein said first releasable fastening means secured to said under garment is a hook and loop-type fastening means, and wherein said second releasable fastening means secured to said ascot means is a complemental hook and loop-type fastening means.

3. An article of clothing, comprising:

an under garment in the form of a bib;

an elongate strap having a first end fixedly secured to a first side of said bib and a second end releasably secured to a second side of said bib;

said strap extending behind the neck of a wearer of said bib when said bib is worn;

a first releasable fastening means secured to said bib just below the uppermost edge of said bib on a rearward side thereof so that said first releasable fastening means is not visible when said bib is worn;

an ascot means having a second releasable fastening means secured to a rear side thereof, near an uppermost end thereof;

said second releasable fastening means of said ascot means releasably engaging the first releasable fastening means of said bib when said ascot means is positioned into overlying relation to said bib and when said uppermost end of said ascot means is folded rearwardly so that said second releasable fastening means overlies said first releasable fastening means;

said ascot means being substantially smaller than said bib; and said bib being substantially covered by a shirt-like outer garment when a shirt-like outer garment is worn over it;

whereby when an outer garment is worn over said bib, said ascot means appears to be held into position by a neck-encircling means, even though no neck-encircling means is provided.

4. The article of clothing of claim 3, wherein said first releasable fastening means secured to said bib is a hook and loop-type fastening means, and wherein the second releasable fastening means secured to said ascot means is a complemental hook and loop-type fastening means.

* * * * *